United States Patent [19]

Lutz

[11] 4,315,649

[45] Feb. 16, 1982

[54] SECURING DEVICE FOR DOORS OR THE LIKE IN VEHICLES

[75] Inventor: Manfred Lutz, Schweinfurt, Fed. Rep. of Germany

[73] Assignee: Fichtel & Sachs AG, Schweinfurt, Fed. Rep. of Germany

[21] Appl. No.: 87,544

[22] Filed: Oct. 23, 1979

[30] Foreign Application Priority Data

Nov. 2, 1978 [DE] Fed. Rep. of Germany ..... 2847589

[51] Int. Cl.[3] ..... E05C 13/06

[52] U.S. Cl. ..... 292/201; 292/336.3

[58] Field of Search ..... 292/144, 201, 336.3

[56] References Cited

U.S. PATENT DOCUMENTS 3,243,216 3/1966 Peters ..... 292/201
3,504,511 4/1970 Allen ..... 292/201 X
3,751,088 8/1973 Schlage et al. ..... 292/201
3,751,950 8/1973 Leger et al. ..... 292/201 X
4,176,867 12/1979 Lipschutz ..... 292/201

*Primary Examiner*—Richard E. Moore
*Attorney, Agent, or Firm*—Toren, McGeady and Stanger

[57] ABSTRACT

A securing device for a vehicle locking mechanism includes an actuating member which can be moved between a locked position and an unlocked position by way of a key. The member has a stop face which faces in the direction of its movement from the locked to the unlocked position. A locking element is arranged to be movable in response to electromagnetic driving means to a position confronting the stop face when the actuating member is in the locked position. Circuit means are provided to energize the driving means in response to operation of the key.

15 Claims, 4 Drawing Figures

SECURING DEVICE FOR DOORS OR THE LIKE IN VEHICLES

BACKGROUND OF THE INVENTION

The present invention relates generally to a securing device for locking mechanisms of the type used in doors or hoods of motor vehicles, the mechanisms being locked by means of a key from outside the vehicle, and particularly to a securing device for a locking mechanism having an actuating member which can be manually moved between locked and unlocked positions from the interior of the vehicle.

Motor vehicle doors can usually be locked by way of pull buttons which are arranged on the door frame in the region of the door window. Inasmuch as the doors can also be locked from outside by means of a key, the locking mechanisms are coupled to the pull buttons. As a result, a door which is locked from the outside by means of a key can also be opened from the outside by unauthorized persons, for example, by inserting a wire into the interior of the vehicle through a gap in the door frame or the window, and by releasing the pull buttons by means of the wire. Once the door is opened, all other locking mechanisms can be successively unlocked from the interior.

An object of the present invention is to provide a securing device whereby unauthorized opening of locking mechanisms in doors, hoods or lids of a vehicle can be prevented, the device being of relatively simple construction.

In accordance with the present invention, the above object is attained by providing a securing device for a vehicle locking mechanism comprising an actuating member which can be moved between a locked position and an unlocked position by way of a key inserted in the mechanism. The member has a stop face thereon facing in the direction of movement of the member from the locked position to the unlocked position. A locking element is arranged to be movable to a position confronting the stop face when the actuating member is in the locked position. Electromagnetic driving means including a driven member is provided for moving the locking element which is coupled to the driven member, and circuit means is coupled to the driving means and the locking mechanism for energizing the driving means in response to operation of the key.

In this manner, each of the locking mechanisms in the vehicle can be secured and can only be opened by means of the key which, for example, locks the door of the vehicle. The securing device of the present invention is particularly useful for the locking mechanisms of doors, since it prevents opening of the door in all cases, even when the locking or pull button at the door is accessible through an open window, for example.

In a preferred embodiment, the driving means comprises an electromotor or rotary magnet on whose driven shaft the locking element is arranged. It is also preferred that self-locking permanent magnet direct current motors be used for the driving means since, in such case, the locking element can be arranged on the driven shaft in an angular position in which it is held by the self-locking torque or stall torque of the motor when the locking element is at the position where it confronts the step face. Accordingly, no additional stop members or the like are required to prevent unintentional unlocking of the locking element due to vibrations, for example. Moreover, by way of a suitable design of the pole angle of the permanent magnet direct current motor, the unlocked position of the locking element can be secured or held in the same manner so that unintentional locking can also be safely prevented while travelling, for example. If necessary, the locking element can be provided with a balancing counterweight.

Besides electromotors or rotary magnets, suitable driving means also include lifting electromagnets or solenoids whose lifting armatures drive the locking elements.

Although the invention is not limited to the use of the securing device in central locking systems, this type of application is preferred. More particularly, the driving means can be associated with a second electromagnetic driving means of the central locking system in a common structural unit, this second driving means operating to move the actuating member between its locked and unlocked positions.

Structural simplicity can be obtained when the second driving means moves the actuating member which is in the form of an elongated rod, the rod being supported for longitudinal movement within a housing of the structural unit, one end of the rod in the housing including a projection having the stop face. The rod can be in the form of a rack, and the second driving means which, for example, comprises an electromotor can include a pinion in meshed engagement with the rack. The locking element is preferably in the form of a pawl which is mounted for pivotal movement about an axis perpendicular to the direction of movement of the actuating member.

The energizing circuit means can be provided with a switch which is mechanically coupled with the vehicle locking mechanism. However, in the event the locking mechanism is operated by the second driving means, this switch may be in the form of a key operated switch having only the electrical and no mechanical contact with the locking mechanism. In this case, the circuit means can be connected to a control circuit of an electrical central locking system. Of course, within the scope of the invention, circuit means can be used which are responsive to magnetic keys or the like.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
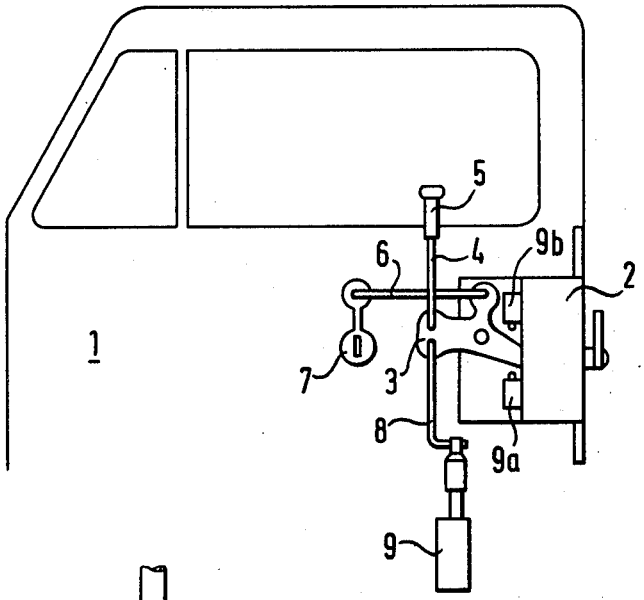
FIG. 1 is a schematic representation of a motor vehicle door including a locking mechanism and a securing device for securing the locking mechanism in accordance with the present invention.

FIG. 1 shows a door 1 of a motor vehicle with a locking mechanism 2 therein. The locking mechanism 2 can be locked in two ways independently from a door grip or door handle (not shown) provided for opening the door 1. A locking lever 3 of the locking mechanism 2 is movable between a locked position and an unlocked position through a connecting rod 4 by way of a locking button 5 which is accessible in the interior of the vehicle. The locking lever 3 is also coupled through a connecting rod 6 to a locking cylinder 7 which can be actuated by means of a key from outside the door 1.

To prevent unlocking of the mechanism 2 by way of the button 5 when the mechanism is locked by the key, an electromagnetic securing device 9 is coupled to the locking lever through an actuating rod 8. The securing device 9 is responsive to switches 9*a* and 9*b* which are connected to an energizing circuit of the securing device 9. When the lock mechanism is not locked through operation of the locking cylinder 7, the door 1 can still be locked and unlocked by means of the locking button 5. Switch 9*a* controls the locking movement of the securing device. Unlocking movement is controlled by switch 9*b*. Switches 9*a*, 9*b* are shown in FIG. 1 in only one of a number of possible arrangements, other arrangements for the switches being within the purview of one skilled in the art. More particularly, switches 9*a*, 9*b* can also be component parts of the locking cylinder 7.

Furthermore, as explained in greater detail below, an electromagnetic driving device may be provided instead of the mechanically actuated locking cylinder 7, particularly in the case of a central locking system. Specifically, a magnetic key can be used for releasing the energizing circuit, rendering a mechanically actuated switch unnecessary.

Figure 2:
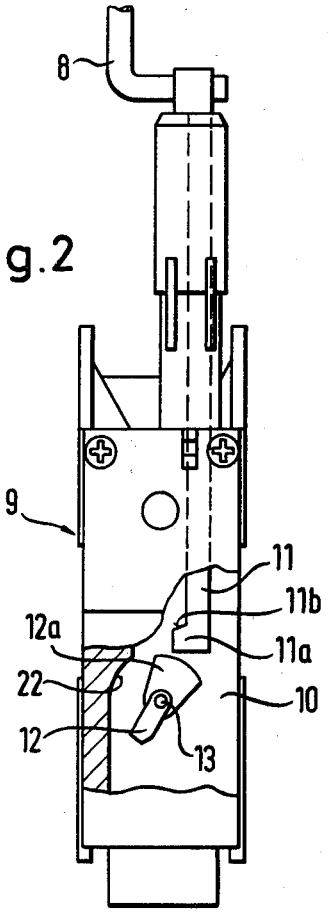
FIG. 2 is a partly broken, enlarged view of the securing device in FIG. 1 in the unlocked condition.

FIG. 2 shows the securing device 9 in more detail. A rod 11 which is coupled to the actuating rod 8 is supported for movement in a housing 10. One end of the rod is located in the housing 10, and has a projection 11*a* from this end which projects in a direction perpendicular to the longitudinal direction of the rod 11. On the projection 11*a*, a stop face 11*b* is arranged which faces in the direction of movement of the rod 11 from its locked position to the unlocked position. The stop face 11*b* interacts with a locking pawl 12 which is arranged on a driven shaft 13 of a permanent magnet direct current motor (not shown in FIG. 2). This permanent magnet direct current motor turns the locking pawl 12 from the unlocked position, shown in FIG. 2 in which the projection 11*a* can move past the locking pawl 12 (a counterweight 12*a* of the pawl 12 being out of the path of movement of projection 11*a*), to a locked position, shown in FIG. 3 wherein the locking pawl 12 prevents the rod 11 from being pulled upwardly by means of the locking button 5. Locking pawl 12 is integrally connected to the counterweight 12*a* which is laterally displaced from the pawl 12 relative to its axis of rotation. Counterweight 12*a* operates to balance the locking pawl 12.

The direction of rotation of the permanent magnet direct current motor can be reversed by means of the switches 9*a* and 9*b*. The motor preferably has a high stall torque so that it is able to hold the locking pawl 12 in its last assumed position, even when energizing current for the motor has been switched off.

Figure 3:
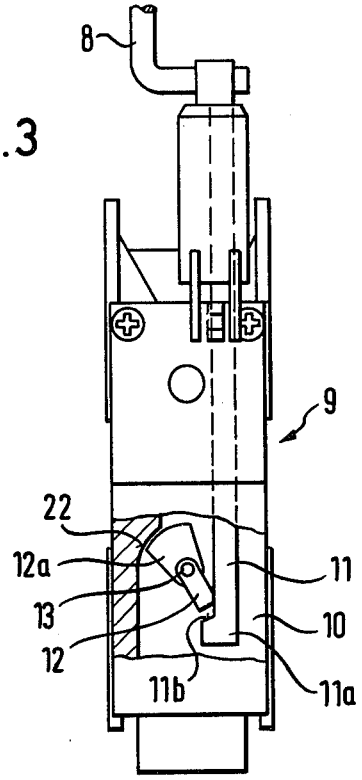
FIG. 3 is a partly broken enlarged view of the securing device in FIG. 1 in the locked condition.
Figure 4:
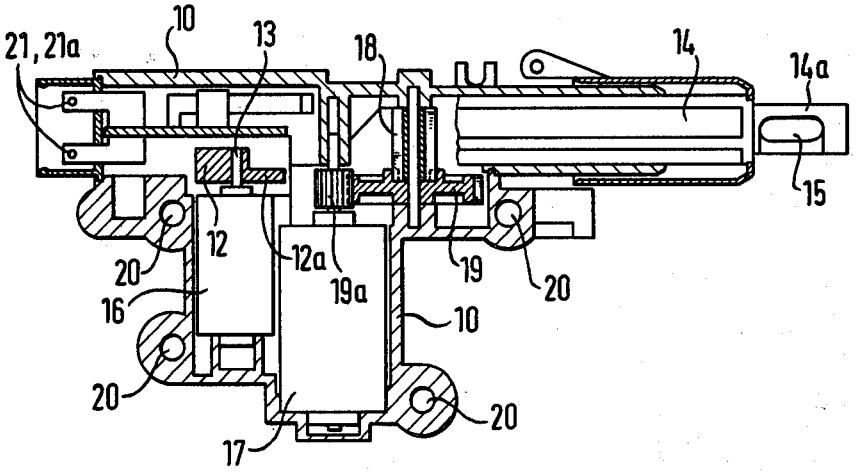
FIG. 4 is a sectional view of the securing device connected to driving means associated with a central locking system, and a common housing to form a structural unit, in accordance with the present invention.

FIG. 4 shows an embodiment in which the securing device, explained above in connection with FIGS. 1 through 3, is combined with a driving member of a central locking system to form a structural unit. Accordingly, these parts which are the same as those in the locking device of FIGS. 1 to 3 are denoted with the same reference numerals. For explanations of these parts, the previous description can be referred to. Those parts in FIG. 4 which differ from those previously described will now be explained.

In the embodiment of FIG. 4, the rod which is provided with a projection 11*a* is in the form of a rack 14 which, at its end 14*a* projecting out of the housing 10, has an oblong hole 15 for engaging the actuating rod 8. An electromotor 17 drives a pinion 18 which is in meshed engagement with the rack 14. Pinion 18, in turn, is coaxially connected to a gear 19. The gear 19 meshes with a pinion 19*a* which is mounted on the driven shaft of the electromotor 17. FIG. 4 also shows the permanent magnet direct current motor 16 on whose driven shaft 13 the locking pawl 12 is arranged. The motor 16 can be connected by way of a contact 21, and the direct current motor 17 can be connected by way of contact 21*a*, to corresponding energizing circuits. The motor 16 preferably includes a three-pole rotor, resulting in pivotal movement through angles of 60° or multiples of 60°. This relatively large pivoting angle in combination with a sufficiently high stall torque ensures that the locking pawl 12 does not lock the rack 14, even in case of high acceleration such as, for example, when the door is slammed with great force or in the case of an accident. Counterweight 12*a* further avoids the likelihood of unintentional locking. Lugs 20 are arranged on the housing 10 for fastening of the structural unit of FIG. 4.

As can best be seen from FIGS. 2 and 3, the housing 10 has a member which forms another stop face 22 which interacts or confronts the outer surface of the counterweight 12*a* when the pawl 12 is in its locked position. In this configuration, the stop face 22 is located roughly diametrically opposite the stop face 11*b* relative to the driven shaft 13. Locking pawl 12 will bear against the stop face 22 through the counterweight 12*a* when a lifting force is applied to the rod 11. In this case, the driven shaft 13 is slightly elastically deformable since a small distance must be provided between the stop face 22 and the outer surface of the counterweight 12*a*, in order to ensure that the locking pawl 12 is free moving. To protect against very high forces which could lead to destruction of the securing device, or other structural elements participating in transmission of forces between components of the device, a predetermined breaking point can be established within the arrangement of the locking button 5, connecting rod 4 and locking lever 3.

While specific embodiments of the invention have been shown and described in detail to illustrate the application of the inventive principles, it will be understood that the invention may be embodied otherwise without departing from such principles.

What is claimed is:

1. A securing device for a vehicle locking mechanism comprising an actuating member which can be moved between a locked position and an unlocked position by way of a key inserted in the mechanism from outside the vehicle; said member having a first stop face thereon facing in the direction of movement of said member from said locked position to said unlocked position, a locking element arranged to be movable to a position confronting said first stop face when said actuating member is in said locked position, first electromagnetic driving means including a driven member for moving said locking element, said locking element being coupled to said driven member, and circuit means coupled to said first driving means and said locking mechanism for energizing said first driving means in response to operation of said key.

2. A securing device according to claim 1, wherein said first driving means comprises an electromotor having a driven shaft and said driven member comprises said driven shaft.

3. A securing device according to claim 1, where said first driving means comprises a rotary magnet having a driven shaft and said driven member comprises said driven shaft.

4. A securing device according to claim 2, wherein said electromotor is a self-locking permanent magnet direct current motor.

5. A securing device according to claim 4, wherein said permanent magnet direct current motor includes a three pole rotor.

6. A securing device according to claim 4, wherein said electromotor has a given self-locking torque and said locking element is arranged on said driven shaft so that said self-locking torque holds said locking element in said position confronting said first stop face.

7. A securing device according to claim 2, further including a member having a second stop face which is located diametrically opposite said first stop face on said actuating member relative to said driven shaft when said actuating member is in said locked position, said second stop face being spaced apart from said locking element so that said locking element will abut said second stop face when said locking element is in said position confronting said stop face and a force is applied to said locking element through said actuating member to elastically deform said driven shaft.

8. A securing device according to claim 2, wherein said locking element includes a balancing counterweight.

9. A securing device according to claim 1, wherein said first driving means comprises a lifting electromagnet having a lifting armature and said driven member comprises said armature.

10. A securing device according to claim 1, further comprising a central locking system including second electromagnetic driving means associated with said first driving means for moving said actuating member between said locked and unlocked positions.

11. A securing device according to claim 10, further comprising a housing for containing said first and second driving means, and said actuating member includes an elongated rod which is supported by said housing for longitudinal movement, one end of said rod being located in said housing and having a projection at said one end which has said first stop face thereon.

12. A securing device according to claim 11, wherein said elongated rod comprises a rack, and said second driving means includes a pinion in meshed engagement with said rack.

13. A securing device according to claim 11, wherein said locking element comprises a pawl which is mounted for pivotal movement about an axis perpendicular to the direction of movement of said elongated rod.

14. A securing device according to claim 1, wherein said circuit means includes a switch which is arranged to be actuated by said locking mechanism.

15. A securing device according to claim 1, further comprising an electrical central locking system including a control circuit, said circuit means being coupled to said control circuit.

* * * * *